United States Patent [19]

Berfield et al.

[11] Patent Number: 4,642,841

[45] Date of Patent: Feb. 17, 1987

[54] HAND HELD VACUUM CLEANER

[75] Inventors: Robert C. Berfield, Jersey Shore; Richard M. Fegan, Cogan Station, both of Pa.

[73] Assignee: Shop-Vac Corporation, Williamsport, Pa.

[21] Appl. No.: 773,589

[22] Filed: Sep. 9, 1985

[51] Int. Cl.[4] ..... A47L 5/24

[52] U.S. Cl. ..... 15/330; 15/344; 15/412; 15/415 R

[58] Field of Search ..... 15/344, 412, 328, 330, 15/415 R

[56] References Cited

U.S. PATENT DOCUMENTS

| | | | |
|---|---|---|---|
| 2,024,367 | 12/1935 | Eriksson | 15/330 |
| 3,331,090 | 7/1967 | Reiber et al. | 15/330 X |
| 4,132,507 | 1/1979 | Akiyama et al. | 15/344 X |
| 4,227,280 | 10/1980 | Comer | 15/330 |
| 4,380,845 | 4/1983 | Miller et al. | 15/344 |
| 4,547,927 | 10/1985 | Berfield | 15/412 X |
| 4,553,284 | 11/1985 | Strumbos | 15/415 R X |

*Primary Examiner*—Chris K. Moore

*Attorney, Agent, or Firm*—Ostrolenk, Faber, Gerb & Soffen

[57] ABSTRACT

A hand held vacuum cleaner is provided with a frictionally held soft plastic nozzle that constitutes a snout for the vacuum cleaner casing. The fan for creating a flow of working air and the motor for driving the fan are parts of a subassembly that is selectively positionable within the casing. In one position of the subassembly, working air is drawn into the casing through the nozzle at the front thereof and is expelled at the rear of the housing. In the other position of the subassembly, working air is drawn in at the rear of the casing and is blown out the front thereof.

15 Claims, 12 Drawing Figures

FIG. 1.
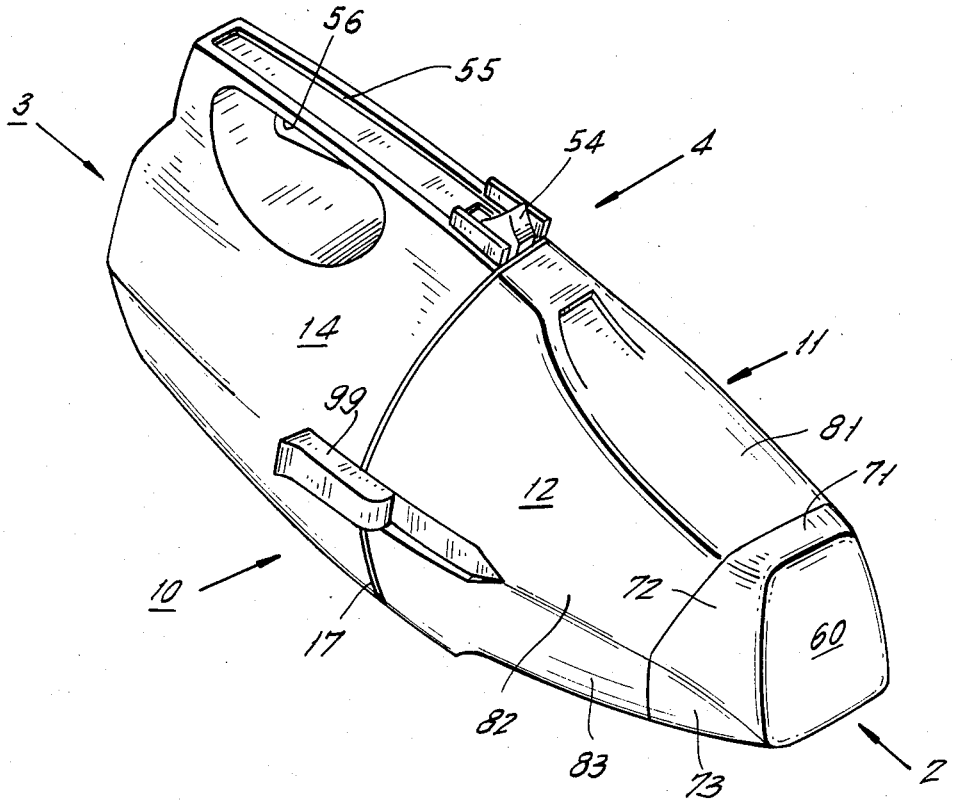
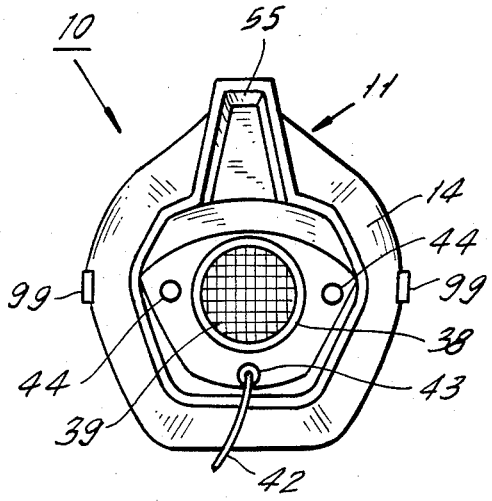
FIG. 3.
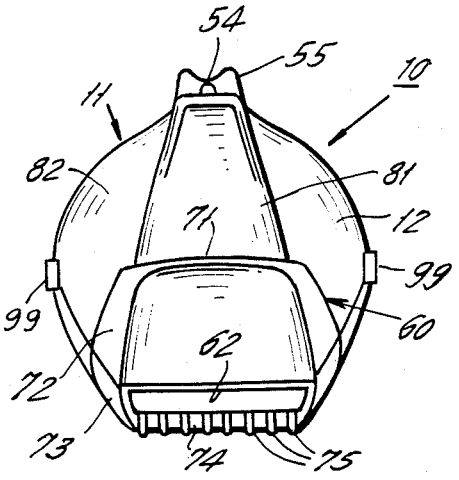
FIG. 2.

60
61
62
63
64
66
68
71
72
73
74
75
9
10
12

HAND HELD VACUUM CLEANER

BACKGROUND OF THE INVENTION

This invention relates to hand held vacuum cleaners in general and more particularly relates to a vacuum cleaner of this type that may readily be converted to a blower.

The R. C. Berfield copending U.S. patent application Ser. No. 658,353 filed Oct. 5, 1984 now U.S. Pat. No. 4,586,214, issued May 6, 1986, discloses a relatively lightweight compact vacuum cleaner that may be conveniently carried while in use. In that type of cleaner, as in many other hand held vacuum cleaners of the prior art, the pickup nozzle or other cleaning tool is connected to the canister by a flexible hose. There are other hand held vacuum cleaner constructions in which the nozzle is connected to the canister by means of a rigid tube. Another prior art construction is described in the J. O. Miller, K. E. Strouse and R. M. Fegan U.S. Pat. No. 4,380,845 issued Apr. 26, 1983 for a Nozzle For a Hand-Held Vacuum. These last two constructions are such that the cleaners are often inconvenient to use because in each case the handle on the canister is so far from the nozzle.

SUMMARY OF THE INVENTION

As will hereinafter be seen, the instant invention provides a hand held vacuum cleaner including a subassembly that is selectively repositionable within the casing whereby the device may be assembled to blow air from the front of the cannister. This subassembly includes a fan and an electric motor for driving the fan. A removable nozzle is mounted directly to the cannister and constitutes a snout having a wide mouth located relatively close to the handle of the cleaner. This provides for convenience in operating the vacuum cleaner. The nozzle is constructed of relatively soft plastic material so that it may be frictionally held by a formation on the cannister, and the snout will not mar delicate surfaces.

Accordingly, the primary object of the instant invention is to provide a novel construction for a hand held vacuum cleaner.

Another object is to provide a vacuum cleaner of this type in which the elements may be assembled to form a blower that directs air out the front of the cannister.

Still another object is to provide a vacuum cleaner of this type having a repositionable subassembly and means for selectively mounting the subassembly in two selected positions.

A further object is to provide a vacuum cleaner of this type having a nozzle in the form of a snout at the front of the cannister.

A still further another object is to provide a vacuum cleaner of this type in which the nozzle is a one-piece frictionally held unit constructed of relatively soft plastic material.

These objects as well as other objects of this invention shall become readily apparent after reading the following description of the accompanying drawings.

BRIEF DESCRIPTION OF THE DRAWINGS

FIG. 1 is a perspective of a hand held vacuum cleaner constructed in accordance with the teachings of the instant invention.

FIGS. 2 and 3 are respective front and rear elevations of the vacuum cleaner of FIG. 1 looking in the direction of the respective arrows 2 and 3.

DESCRIPTION OF THE PREFERRED EMBODIMENT

Figure 7:
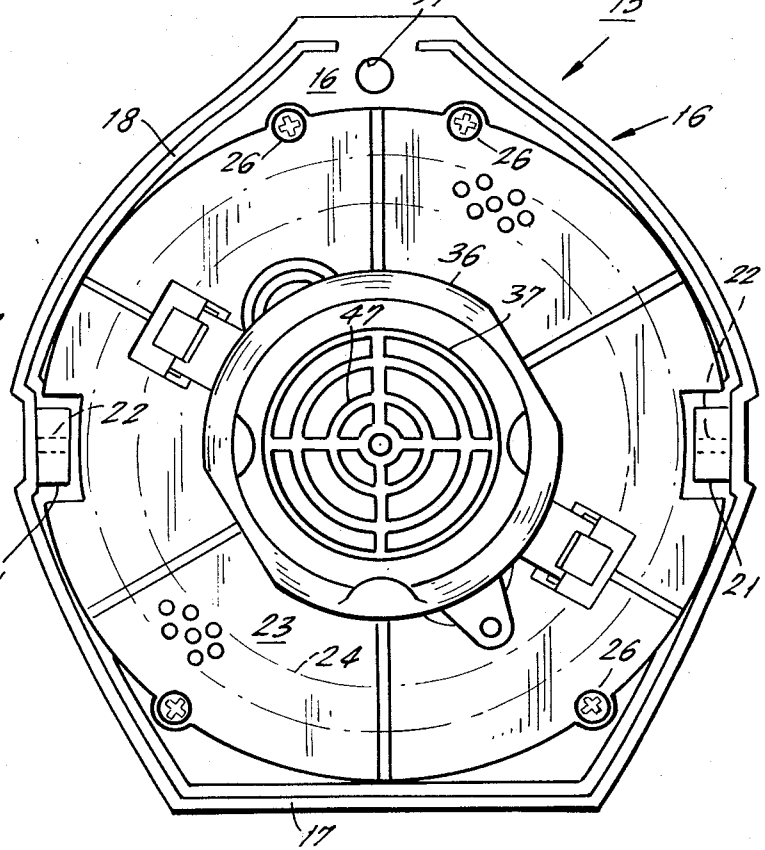
FIG. 7 is a rear elevation of the fan/motor subassembly looking in the direction of arrows 7—7 of FIG. 6.
Figure 6:
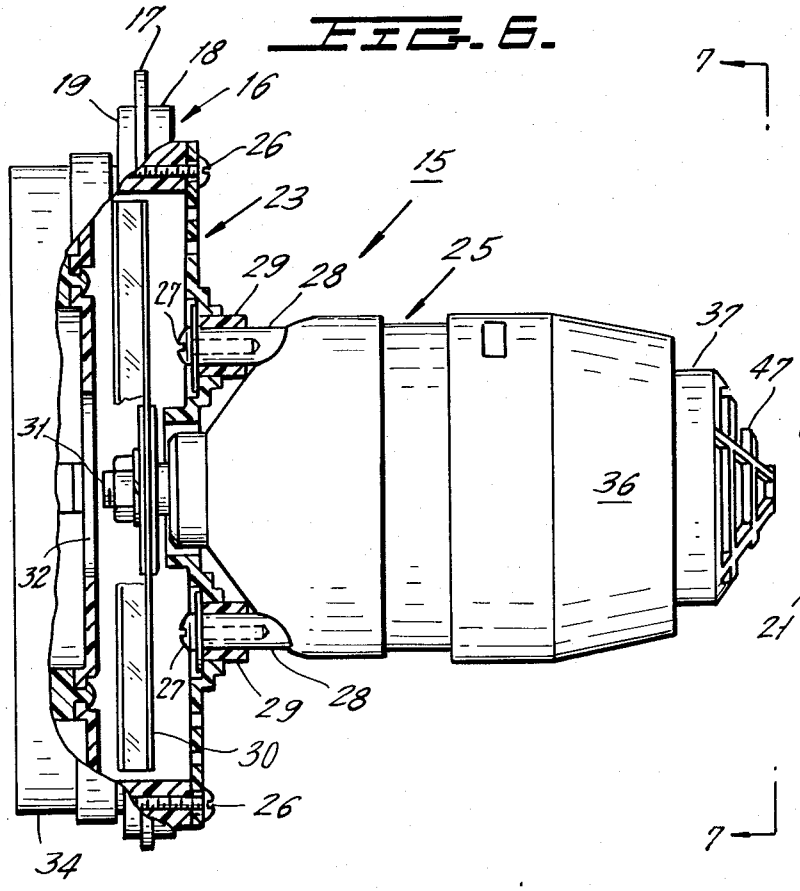
FIG. 6 is a side elevation of the fan/motor subassembly.
Figures 8, 9, 10, 11, 12:
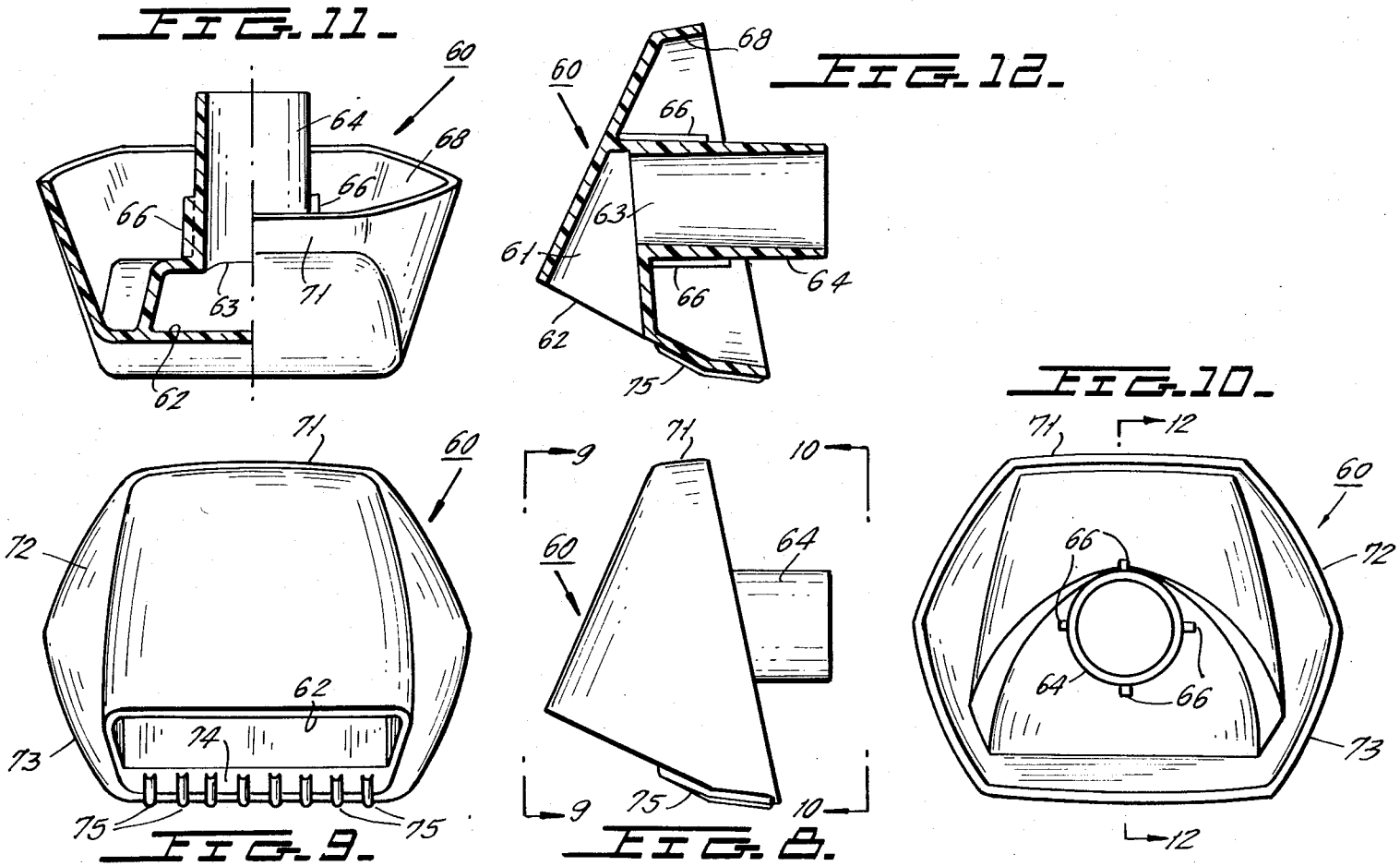
FIG. 8 is a side elevation of the plastic nozzle.
FIG. 9 is a front elevation of the nozzle looking in the direction of arrows 9—9 of FIG. 8.
FIG. 10 is a rear elevation of the nozzle looking in the direction of arrows 10—10 of FIG. 8.
FIG. 11 is a partially sectioned plan view of the nozzle.
FIG. 12 is a cross-section taken through the line 12—12 of FIG. 10 looking in the direction of arrows 12—12.

Now referring to the drawings and more particularly to FIGS. 1–4 which show cannister type vacuum cleaner 10 constructed in accordance with teachings of the instant invention. Vacuum cleaner 10 includes casing 11 constructed of tank section 12 at the front thereof and motor housing section 14 at the rear. Disposed within casing 11 is subassembly 15 (FIGS. 6 and 7) that includes molded plastic mounting member 16 having a narrow peripheral band that is clamped between the rear of tank section 12 and the front of housing section 14. Angular alignment of casing sections 12 and 14 is achieved by ledge formations 18, 19 that protrude from opposite sides of mounting member 16. Diametrically opposed axial extensions 21, 21 of mounting member 16 are provided with apertures 22 that receive screws (not shown) which secure buckles 99 to opposite side of housing section 14.

Mounting plate 23 having a narrow band of small apertures 24 is secured to mounting member 16 by four screws 26. Two other screws 27 extend into posts 28 that are surrounded by rubber-like bushings 29 to secure motor 25 to the rear of plate 23. Fan impeller 30 is mounted to the forward end of motor shaft 31 to rotate therewith and draw working air rearward through central aperture 32 at the rear of mounting member 16. The working air is then directed rearward through apertures in band 24 to move axially through along the outside of motor 25, for reasons to be hereinafter explained.

Heat staked to the front of the mounting member 16 is grill element 34 having a plurality of inwardly extending ears 33 (FIG. 4) which removably hold filter disk 35 in front of the fan inlet 32 so that only filtered air will impinge upon motor 25. The rear of motor 25 is covered by end bell 36 having reduced diameter portion 37 that is received by the forward end of positioning sleeve 38 whose forward generally open end is provided with grill 39. Sleeve 38 extends into external recess 41 at the rear of housing section 14. Power cord 42 for energizing motor 25 extends through strain relief grommet 43 that is positioned within an aperture at the forward boundry of recess 41.

With motor 25 disposed within housing section 14, working air exits at the rear of the latter through apertures 44 and there is a substantial flow of air through the clearances between portions of end bell 36 and stator 46 of motor 25, with this air flowing through grill 47 at the rear of end bell 36 and grill 39.

Air if drawn into tank section 12 through an aperture in the front thereof which is surrounded by rearwardly extending sleeve 48 whose inner end is normally closed by circular flapper 49 of check valve unit 50. The latter is constructed of a single piece of relatively soft flexible plastic material. The portion of unit 50 outboard of flapper 49 overlaps the rear side wall section of sleeve 48 and frictionally engages the inner surface of outer sleeve 51. The latter is also disposed within tank section 12 and surrounds sleeve 48 while extending to the rear thereof. The outer surface of sleeve 51 frictionally holds ring 52 that supports porous paper dirt collecting bag 53 that is disposed within tank section 12, to the rear of outer sleeve 51.

Slide switch 54 disposed at the top of housing section 14 selectively controls energization of motor 25. Opening 56 at the rear upper portion of housing section 14 provides clearance to form handle 55. The latter is positioned so that a hand engaged therewith may also operate control switch 54.

The front or snout for casing 11 is provided by nozzle 60 which is a single element unit molded of deformable relatively soft plastic material. As seen best in FIGS. 8–12, nozzle 60 includes chamber 61 having elongated generally rectangular inlet 62 at the bottom thereof and circular outlet 63 at a location remote from inlet slot 62. Extending rearward from outlet 63 is hollow circular neck 64 having a slightly tapered outer surface which frictionally engages the inner surface of sleeve 48 to removably mount nozzle 60 to tank section 12. The limit of insertion for neck 64 into sleeve 48 is established by four stops 66 that protrude radially from the outer surface of neck 64 and engage the forward surface of wall 67 at the front of tank section 12. Peripheral wall portions 68 of nozzle 60 rest on ledge 69 which is a peripheral depression on the outside of tank section 12 formed adjacent front surface 67 thereof. As seen best in FIG. 1, the wall sections, for instance sections 71, 72, 73, of nozzle 60 that extend forward of tank section 12 blend with the adjacent wall sections of the latter to appear as continuations thereof. For example, wall sections 71, 72, 73 of nozzle 60 blend with and appear as extensions of the respective wall sections 81, 82, 83 of tank section 12.

Downwardly facing wall 74 of nozzle 60, having inlet slot 62, is provided with eight protrusions or ridges 75 that are in spaced, paralled, side-by-side relationship. Ridges 75 extend rearwardly from the rear edge of slot 62 and assure that slot 62 will not be closed accidentally, even when nozzle 60 is placed on a hard surface. Buckles 90 bridge the gap occupied by narrow rim 17 and removably secure tank section 12 and housing section 14 together while clamping rim 17 therebetween.

Figure 4:
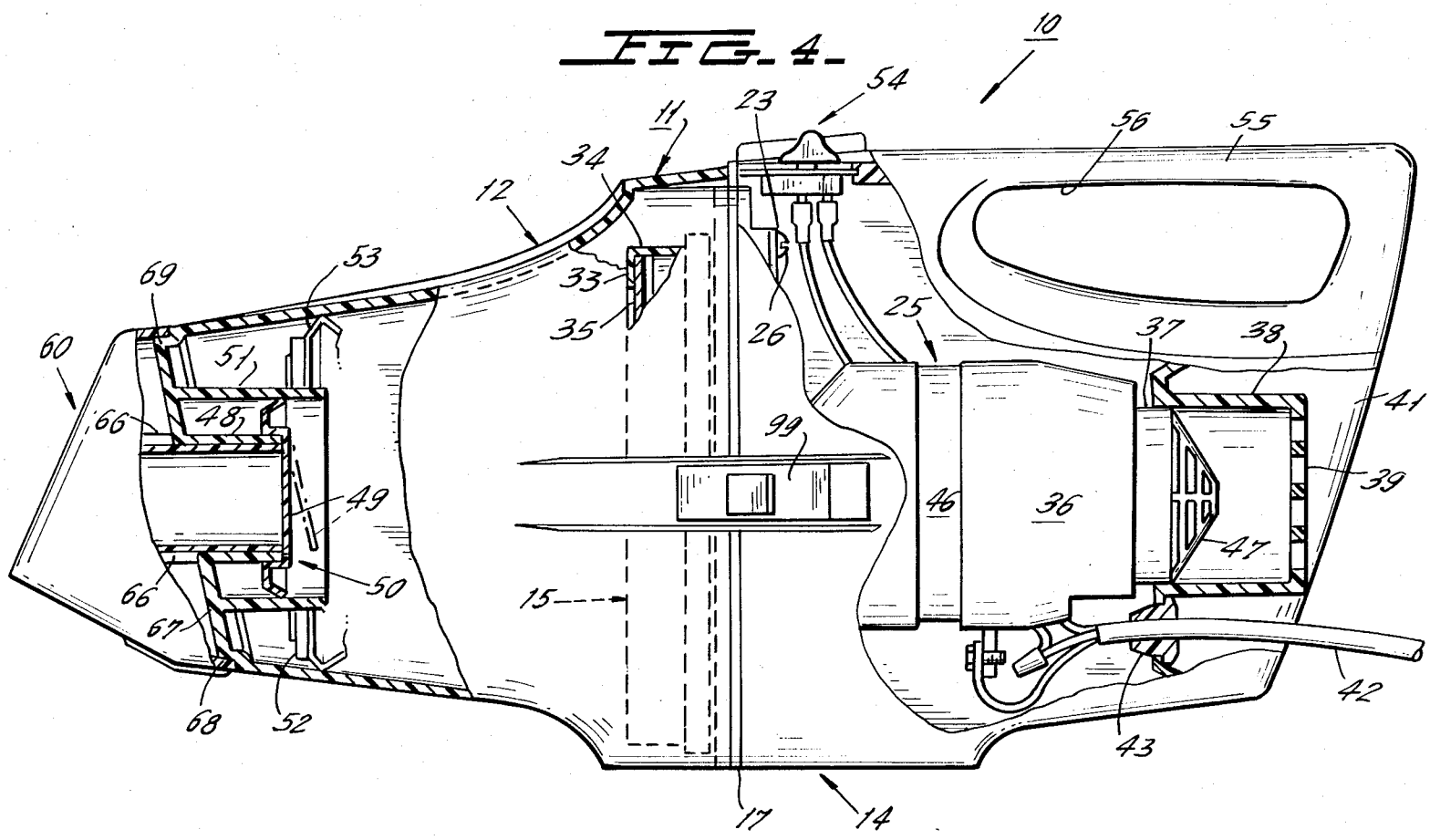
FIG. 4 is a side elevation, partially sectioned, of the vacuum cleaner of FIG. 1 looking in the direction of arrow 4.
Figure 5:
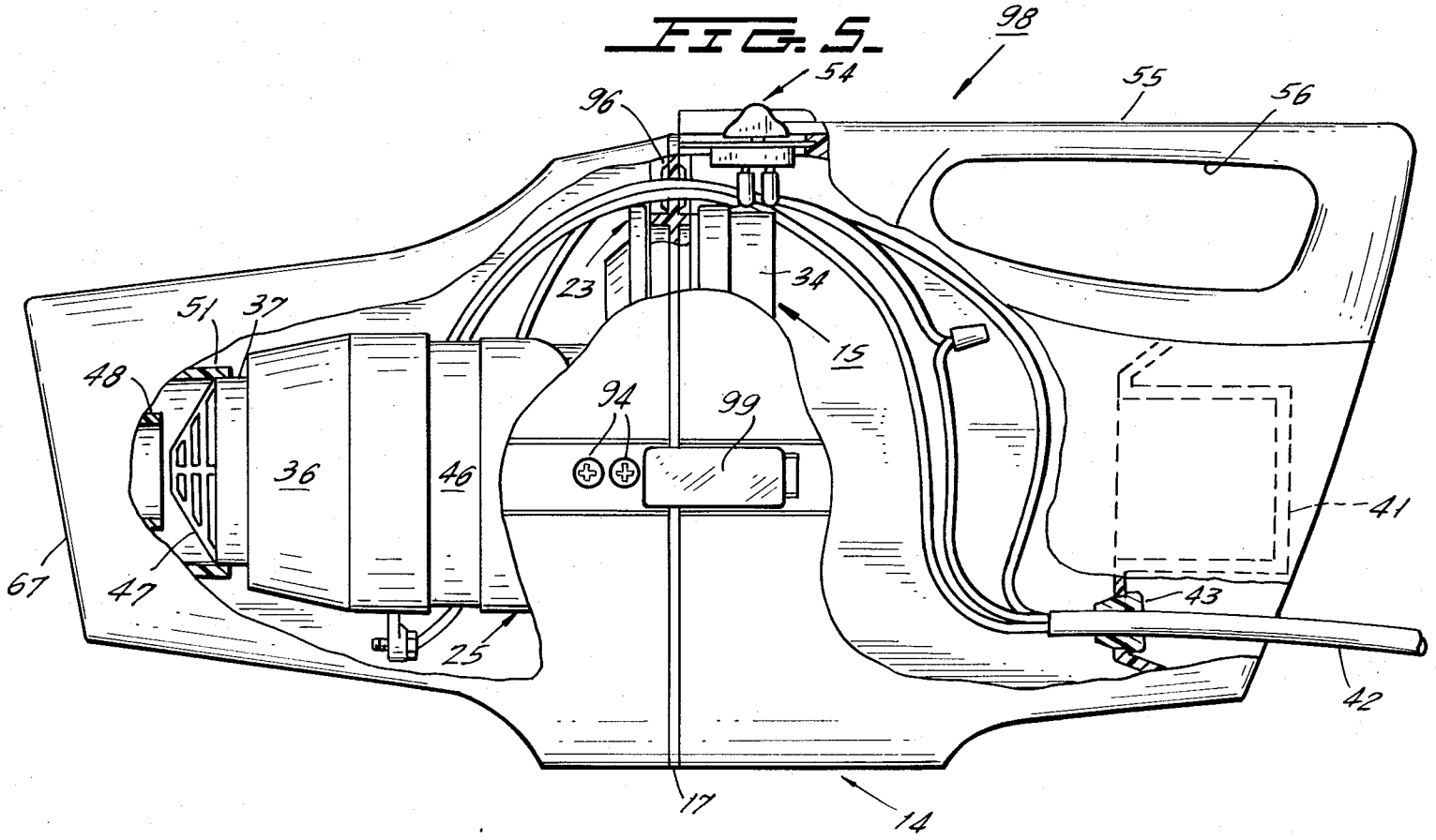
FIG. 5 is an elevation similar to that of FIG. 4 showing the fan/motor subassembly reversed in the casing to provide a unit in which air is blown from the front of the casing.

Reference is now made to FIG. 5 which illustrates how the elements previously described may be utilized to construct a unit that blows air out the front of tank section 12. That is, the major difference between blower 98 of FIG. 5 and vacuum 10 of FIG. 4 is that the position of subassembly 15 is reversed so that motor 25 is disposed within tank section 12 and fan impeller 30 is behind motor 25. In addition, blower unit 98 does not have snout 16 and does not have check valve unit 50 or bag 53. Further, weakened section 97 (FIG. 7) is broken away and fitted with grommet 96 through which electric leads are passed for energizing motor 25. Screws 94 extend through opposite sides of tank section 12 and are received by apertures 22 in mounting member extensions 21 to stabilize subassembly 15. Motor end bell 36 is stabilized by the rear portion of outer sleeve 51 that receives end 37 of end bell 36.

It should also now be obvious to those skilled in the art that snout 60 may be removed from vacuum cleaner 10 and replaced by a set of tools (not shown) connectible to inlet sleeve 48 by a flexible hose (not shown). For such a situation, casing 11 may be provided with a shoulder strap (not shown).

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A vacuum cleaner including:

a casing, fan means within said casing, a motor within said casing and drivably connected to said fan means whereby the latter rotates to create a stream of working air that flows axially through said casing between first and second openings at opposite ends thereof;

said casing including a forward tank section having said first opening therein and a rear housing section having said second opening therein, said tank section being separable from said housing section;

a subassaembly including said motor, said fan means and a support means to which said motor and said fan means are secured;

said casing having positioning formations constructed to cooperatively engage said subassembly for selectively mounting the latter in a first and a second position relative to said casing;

with said subassembly in said first position said motor being behind said fan means and said working air entering said casing through said first opening and exiting from said casing through said second opening;

with said subassembly in said second position said motor being forward of said fan means and said working air entering said casing through said second opening and exiting from said casing through said first opening.

2. A vacuum cleaner as set forth in claim 1 in which the motor includes a first end remote from the fan means; with said subassembly in said first position said motor having its said first end disposed within said housing section, and with said subassembly in said second position said motor having its said first end disposed within said tank sections.

3. A vacuum cleaner as set forth in claim 2 in which the tank section is substantially open at its rear and the housing section is generally open at its front.

4. A vacuum cleaner as set forth in claim 3 in which the support means includes a narrow band formation along the periphery thereof; said band formation being disposed between the rear of the tank section and the front of the housing section.

5. A vacuum cleaner as set forth in claim 4 also including a releasable latch means securing said tank section and said housing section together with said band formation clamped therebetween.

6. A vacuum cleaner as set forth in claim 5 in which the housing section is provided with a handle formation.

7. A vacuum cleaner as set forth in claim 2 in which the positioning formations include an outer sleeve disposed within said tank section, surrounding said sleeve and extending rearward of the latter; said first end of said motor extending into and being positioned by said outer sleeve when said subassembly is in said second position.

8. A vacuum cleaner as set forth in claim 7 also including a check valve unit to block forward flow through said sleeve; said unit being removably mounted within said outer sleeve and positioned adjacent the rear of said sleeve.

9. A vacuum cleaner as set forth in claim 8 in which the check valve unit is held by frictional engagement with the interior wall of the outer sleeve.

10. A vacuum cleaner as set forth in claim 1 also including:

a sleeve surrounding said first opening and extending rearward therefrom;

a nozzle at the front of said casing;

said nozzle constructed of relatively soft plastic and including a tubular neck extending rearward into frictional engagement with said sleeve whereby said nozzle is releasably mounted to said casing.

11. A vacuum cleaner as set forth in claim 10 in which the nozzle includes a chamber and a downwardly facing surface having an elongated slot through which said working air is drawn into said chamber; said neck extending rearward from said chamber at a location remote from said slot and defining a passage through which said working air flows from said chamber into said casing.

12. A vacuum cleaner as set forth in claim 11 in which there are a plurality of spaced side-by-side ridges in the downwardly facing surface of said nozzle; said ridges extending rearward from the vicinity of a long side of the slot.

13. A vacuum cleaner as set forth in claim 11 in which the nozzle constitutes a snout for said casing.

14. A vacuum cleaner as set forth in claim 13 in which the casing is formed with a narrow depressed peripheral ledge extending rearward from the front of the casing; said nozzle having a portion that encloses and rests upon said ledge.

15. A vacuum cleaner as set forth in claim 14 in which surfaces of said nozzle and adjacent surfaces of said casing are contoured to blend with and appear as continuations of each other.

* * * * *